US009193574B2

(12) United States Patent
Krulitsch et al.

(10) Patent No.: US 9,193,574 B2
(45) Date of Patent: Nov. 24, 2015

(54) FILLING ELEMENT, METHOD AND FILLING SYSTEM FOR FILLING CONTAINERS

(75) Inventors: Dieter-Rudolf Krulitsch, Bad Kreuznach (DE); Jonathan Lorenz, Bad Kreuznach (DE); Manfred Härtel, Bretzenheim (DE); Andreas Fahldieck, Idar-Oberstein (DE); Ludwig Clüsserath, Bad Kreuznach (DE)

(73) Assignee: KHS GmbH, Dortmund (DE)

( * ) Notice: Subject to any disclaimer, the term of this patent is extended or adjusted under 35 U.S.C. 154(b) by 293 days.

(21) Appl. No.: 13/808,933

(22) PCT Filed: May 17, 2011

(86) PCT No.: PCT/EP2011/002424

§ 371 (c)(1), (2), (4) Date: Jan. 8, 2013

(87) PCT Pub. No.: WO2012/007076

PCT Pub. Date: Jan. 19, 2012

(65) Prior Publication Data

US 2013/0112311 A1 May 9, 2013

(30) Foreign Application Priority Data

Jul. 16, 2010 (DE) ..... 10 2010 027 511

(51) Int. Cl.
*B67C 3/26* (2006.01)
*B67C 3/28* (2006.01)

(52) U.S. Cl.
CPC ... *B67C 3/26* (2013.01); *B67C 3/28* (2013.01); *B67C 2003/2645* (2013.01)

(58) Field of Classification Search
CPC ..... B67C 3/26; B67C 3/28; B67C 3/286; B67C 3/287; B67C 2003/2645
USPC ..... 141/1, 9, 11, 82, 100, 105, 392
See application file for complete search history.

(56) References Cited

U.S. PATENT DOCUMENTS 3,797,535 A * 3/1974 Kaiser ..... 141/46
5,865,225 A * 2/1999 Weiss ..... 141/198
6,474,368 B2 * 11/2002 Clusserath et al. ..... 141/6
7,299,607 B2 * 11/2007 Clusserath et al. ..... 53/503

(Continued)

FOREIGN PATENT DOCUMENTS

EP 1266862 12/2002
JP H06183492 7/1994

(Continued)

*Primary Examiner* — Nicolas A Arnett
(74) *Attorney, Agent, or Firm* — Occhiuti & Rohlicek LLP

(57) ABSTRACT

A filling element for free jet filling of containers with a liquid charge includes a housing having a liquid channel formed therein, a liquid valve provided upstream of a dispensing opening, and an actuator device for actuating the liquid valve for controlled discharge of the liquid charge via the dispensing opening into a container arranged with a container opening thereof spaced below the dispensing opening. In an open state thereof, the liquid valve forms an opening gap through which the liquid charge flows. This opening gap has a gap width of at least four millimeters. The actuating device for the liquid valve is configured to cause the liquid valve to be in the open state for at least one hundred milliseconds.

17 Claims, 3 Drawing Sheets

(56) References Cited

U.S. PATENT DOCUMENTS

| | | | | |
|---|---|---|---|---|
| 7,650,916 | B2 * | 1/2010 | Clusserath | 141/95 |
| 8,517,065 | B2 * | 8/2013 | Conforti | 141/146 |
| 8,590,581 | B2 * | 11/2013 | Clusserath | 141/9 |
| 8,726,946 | B2 * | 5/2014 | Clusserath et al. | 141/6 |
| 8,763,654 | B2 * | 7/2014 | Gras et al. | 141/104 |
| 8,833,407 | B2 * | 9/2014 | Clusserath et al. | 141/128 |
| 2001/0045242 | A1 * | 11/2001 | Clusserath et al. | 141/144 |
| 2009/0236007 | A1 * | 9/2009 | Clusserath et al. | 141/9 |
| 2009/0293985 | A1 * | 12/2009 | Till et al. | 141/1 |
| 2011/0039044 | A1 * | 2/2011 | Clusserath | 428/34.1 |
| 2011/0303325 | A1 * | 12/2011 | Gras et al. | 141/105 |
| 2013/0126043 | A1 * | 5/2013 | Clusserath | 141/286 |

FOREIGN PATENT DOCUMENTS

| | | |
|---|---|---|
| WO | 2008/126119 | 10/2008 |
| WO | 2009/135591 | 11/2009 |
| WO | 2010/112143 | 10/2010 |

* cited by examiner

FILLING ELEMENT, METHOD AND FILLING SYSTEM FOR FILLING CONTAINERS

CROSS REFERENCE TO RELATED APPLICATION

This application is the national phase under 35 USC 371 of international application no. PCT/EP2011/002424, filed May 17, 2011, which claims the benefit of the priority date of German application no. 10 2010 027 511.5, filed Jul. 16, 2010. The contents of the aforementioned applications are incorporated herein in their entirety.

FIELD OF DISCLOSURE

The invention concerns a filling element for filling containers with a liquid charge in the form of a free jet.

BACKGROUND

A fundamental problem of known filling systems is that of preventing ambient air from penetrating through a dispensing opening and into the liquid channel of valve chamber of a filling element. It is important to do so because air that has penetrated into the liquid channel causes air bubbles that eventually rise into the product lines and finally into the boiler that supplies liquid charge to all the filling elements of the filling system. This can lead to contamination of charge in the product lines and in the boiler. It can also lead to loss of measurement accuracy because rising air bubbles may interfere with operation of flow meters or other measurement devices.

In known filling elements, an actuator opens the liquid valve as quickly and completely as possible. In these known filling elements, a valve can be completely open within as few as 50 milliseconds.

A liquid valve has a gap across its opening. The width of this gap when the valve is fully open is known to have an effect on how much air penetrates into the channel. According to generally established opinion, an effective way to prevent air from penetrating into the liquid channel of the filling element is to make make the width of this gap as small as possible. In most known filling systems, the gap width is approximately 1.0 mm to 1.5 mm.

An additional way to suppress entry of ambient air is to use a gas lock in the liquid channel. A gas lock has a multiplicity of passages, each with minimum flow cross section. These narrow passages make it difficult for ambient air to penetrate and thus suppress formation of air bubbles rising in the filling element and in the product lines.

These known free-jet filling elements are effective when the contents of the container are purely liquid. However, in some cases, the contents include solid constituents. For example, fruit juices may include suspended solids such as fruit flesh and/or fruit fibers, or pulp. These products require gap sizes or gap widths for the gap of the open filling element of more than 3 millimeters. This is much greater than the usual range of 1-1.5 millimeters that has been found effective to reduce ingress of air.

Obviously, making the gap wide enough to accommodate fruit pulp and the like would likely lead to the penetration of air bubbles into the liquid channel and via the product channels or lines into the product boiler.

SUMMARY

An object of the invention is to develop a free-jet filling element in which the gap width of a gap formed when the liquid valve is fully opened is large enough to allow free-jet filling of products with solid constituents without the risk of ambient air penetrating into the liquid channel of the filling element, and hence without the risk of air bubbles rising into the liquid channel of the filling elements and into the product lines.

The invention is based on the surprising discovery that if a valve is opened more slowly, ambient air is less likely to penetrate into the liquid channel of the filling element.

It is believed that by opening the valve more slowly, for example by taking at least 100 milliseconds to fully open a valve, one avoids excessive agitation of the charge within the liquid channel. This, in turn, avoids the entry of ambient air in the filling system.

The invention also ensures that the, when the liquid valve is opened, the liquid in the charge column above the valve and in the product lines leading to the filling element moves with high acceleration.

The acceleration of the charge column present is sufficiently high if the flow cross-section for the liquid charge that results during the opening of the liquid valve is filled completely and immediately with the charge and the charge flows through the flow cross-section with sufficient flow speed so there is no chance of penetration of ambient air. This high acceleration results in part from having the charge flow through a gap that is larger than those conventionally used.

In a preferred embodiment of the invention, the opening time of the liquid valve is greater than 100 milliseconds but smaller than 1000 milliseconds.

Preferably, the opening time lies in the range between 400 milliseconds and 600 milliseconds. In some embodiments, the gap width of the gap through which charge flows when the liquid valve is completely opened is greater than 4 millimeters. In other embodiments, it is greater than 8 millimeters but less than 20 millimeters, and in yet other embodiments, it is between 13 and 16 millimeters. The filling element according to the invention is designed without a gas lock.

In some embodiments of the invention, the liquid valve's opening speed is variable. In some of these embodiments, the opening speed rises as the gap width increases. In some embodiments, the opening speed adapts to the acceleration behavior of the product column present in the filling element or at the liquid valve so that a full charge jet can always be achieved. This will safely avoid the penetration of air bubbles with minimum filling times.

Adaptation of the opening speed is achieved, for example, by corresponding geometric design of the liquid valve or the valve body of the liquid valve and/or those segments of the liquid channel that hold this valve body at least at the start of the opening of the liquid valve, and/or by corresponding formation and/or control of an actuator device for the liquid valve or its valve body.

As used herein, the term "substantially" includes deviations from the precise value concerned by ±10%, preferably ±5%, and/or deviations in the form of changes not significant for the function.

As used herein, "free-jet filling" refers to a method in which the liquid charge flows to the container to be filled in the form of a free jet of liquid, and in which the container's mouth or opening does not lie against the filling element but is spaced from the filling element or a dispensing opening thereof. An essential feature of this method is also that the air displaced from the container by the liquid product during the filling process does not enter the filling element or a gas-carrying region or channel formed therein but flows freely into the environment.

An "gap," as used herein, refers to the usually annular gap that is formed in the region of the liquid valve when the valve opens to pass liquid charge and through which flows the liquid charge towards the dispensing opening, emerging at the dispensing opening as a free jet of liquid charge.

As used herein, "gap width" refers to a width of the gap, preferably the minimum width of the gap when, for example, the gap has a spatially-varying width.

As used herein, the "opening time" of the liquid valve is the time span between the time at which the valve begins to open and the time at which it is fully open.

The "opening speed" of the liquid valve is the time-dependent change in opening or flow cross-section of the gap on opening of the liquid valve.

As used herein, "containers" refers to general packaging means that are normally used for liquid and/or paste-like products, in particular drinks, for example soft packaging formed from flat material, containers of metal, glass and/or plastic, for example cans, bottles etc.

Refinements, advantages and possible applications of the invention arise from the description below of embodiment examples and from the figures. All features described and/or shown in diagrams in themselves or in any combination are in principle the subject of the invention. Also the content of the claims is an integral part of the description.

BRIEF DESCRIPTION OF THE FIGURES

These and other features of the invention will be apparent from the following detailed description and the accompanying figures, in which.

DETAILED DESCRIPTION

Figure 1:
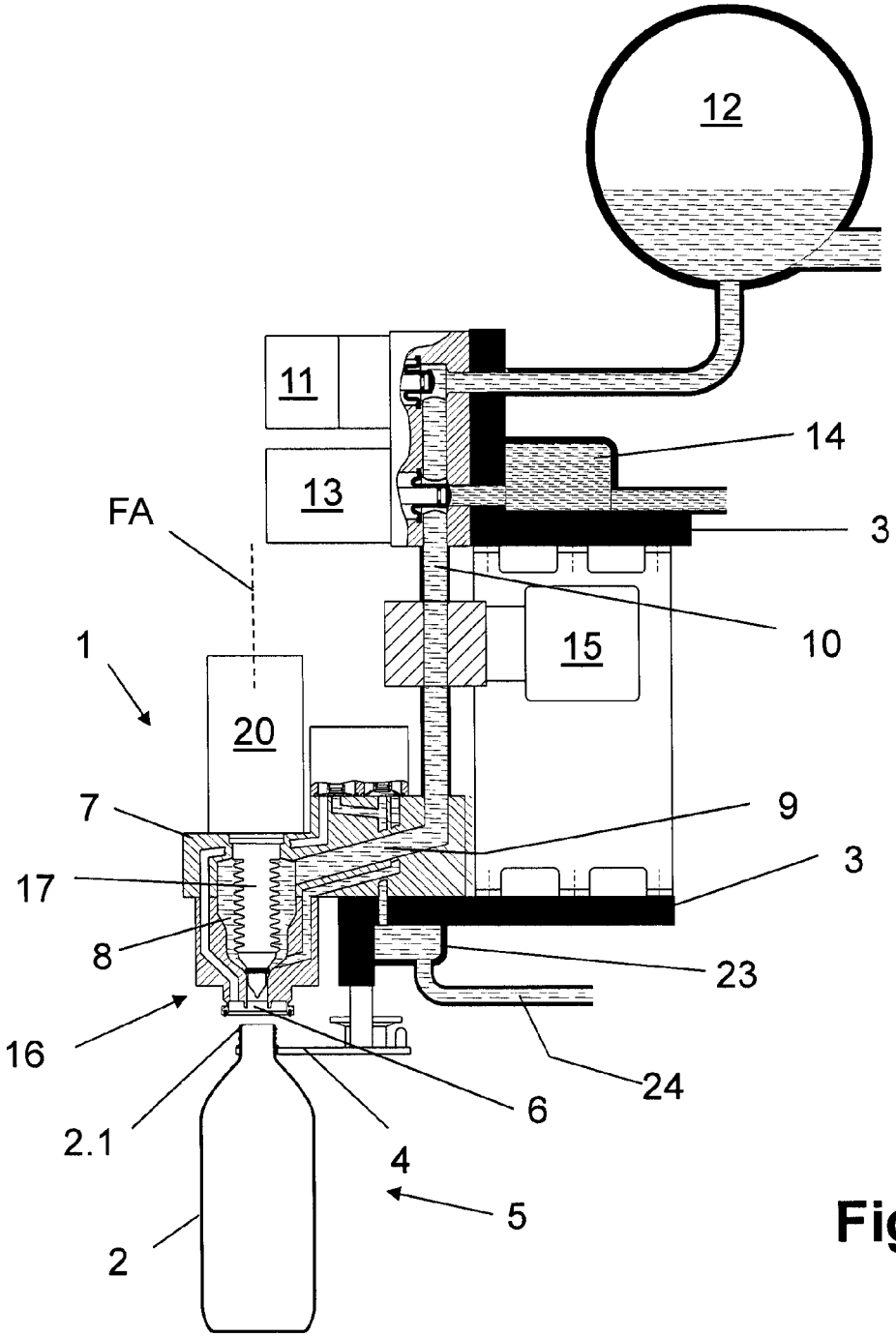
FIG. 1 shows, in simplified depiction and in cross-section, a filling element of a filling system or a filling machine for free-jet filling of containers in the form of bottles with a liquid charge which may also contain solid constituents, with the liquid valve closed.

FIG. 1 shows a filling element 1 for free-jet filling of bottles 2 with a charge. The charge has two constituents. A first constituent is mostly liquid. A second constituent is mostly solid. An example of a liquid constituent is fruit juice. An example of a solid constituent is fruit fiber, fruit flesh, pulp, and/or fruit pieces suspended in a liquid suspension medium.

The filling element 1, together with a container carrier 4, form a filling position 5 that is one of a multiplicity of similar filling positions 5 on the periphery of a rotatable rotor 3.

During filling, the container carrier 4 suspends a bottle 2 by its opening flange with its bottle opening 2.1 arranged below and separated from a dispensing opening 6 of the filling element 1. The container carrier 4 suspends the bottle 2 so that the bottle 2 is coaxial or substantially coaxial with a vertical filling-element axis FA. As a result, during filling, charge flows into the bottle 2 as a free charge jet FS, best seen in FIG. 2.

The filling element 1 includes a housing 7 in which is formed a liquid channel 8. This liquid channel 8 defines a valve chamber of a liquid valve 16. A lower end of the liquid channel 8 has a dispensing opening 6 through which charge flows in response to opening and closing of the liquid valve 16. An upper end of the liquid channel 8 connects, via a product-channel segment 9, with the lower end of a product channel 10. In the illustrated embodiment, the product channel 10 is vertical.

At an upper region thereof, the product channel 10 connects to both a boiler 12 and a ring channel 14. During the filling operation, the boiler 12 and the ring channel 14 contain the first and second charge constituents respectively. A first metering valve 11 between the product channel 10 and the boiler 12 meters the quantity of the first constituent. A second metering valve 13 between the ring channel 14 and the product channel 10 meters the quantity of the second constituent. All the filling elements 1 on the rotor 3 are connected to the same boiler 12 and ring channel 14.

A flow meter 15 arranged in the product channel 10 supplies a signal corresponding to the charge flow through the product channel 10. This signal is provided to a central control unit, such as a computer-supported machine controller. In some embodiments, the flow meter is an electromagnetic flow meter.

The signal from the first and second metering valves 11, 13 provides a basis for adjusting a mixing ratio of the two components based on a recipe. The signal from the flow meter 15 provides a way to tell if enough charge has been introduced into a bottle 2 so that the liquid valve 16 can be closed.

Figure 3:
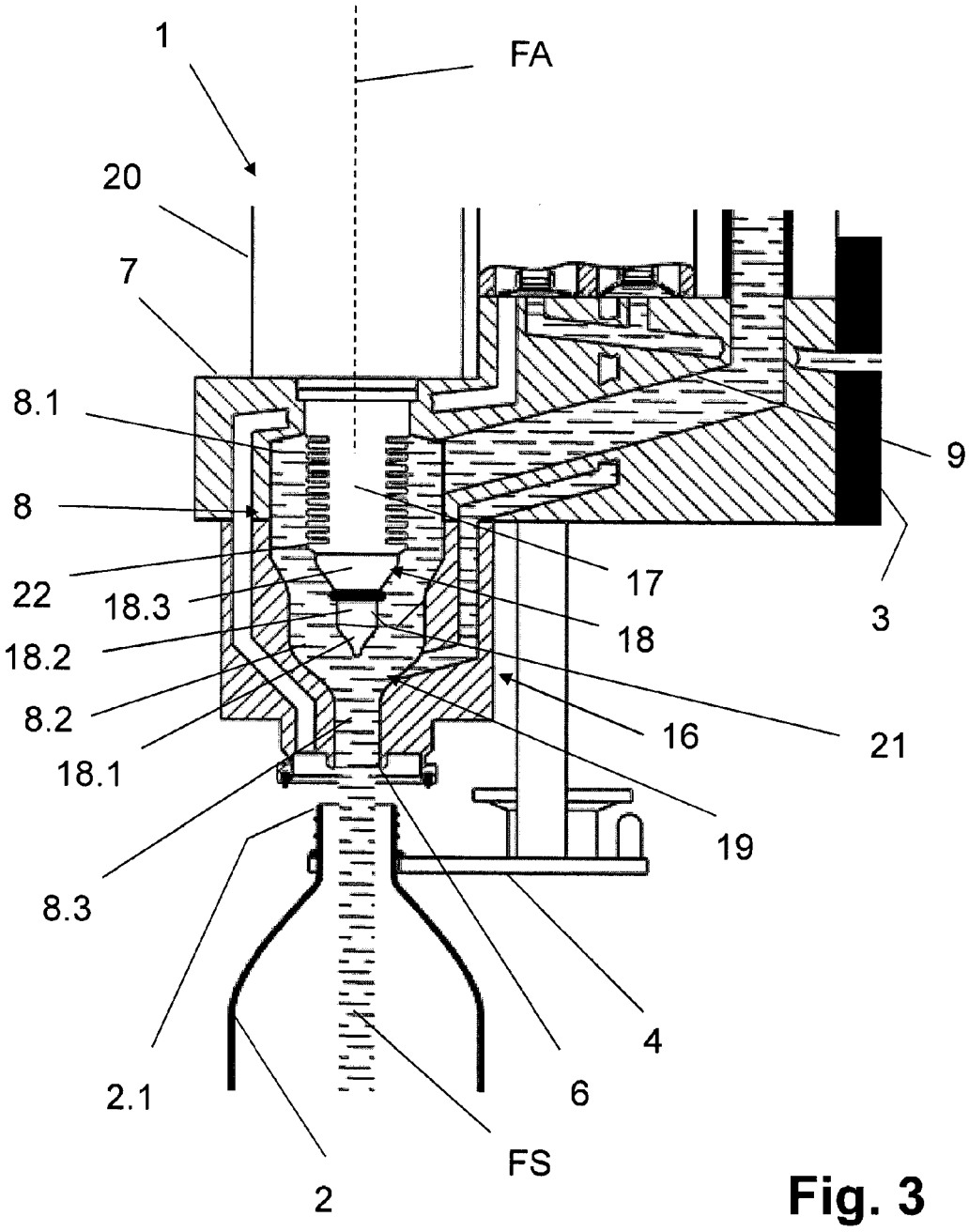
FIG. 3 shows an enlarged part view of the opened liquid valve.

Referring to FIG. 3, the liquid valve 16 comprises a tappet 17 that is coaxial with the filling-element axis FA. A lower end of the tappet 17 forms a valve body 18 with a valve-body seal that concentrically surrounds the filling-element axis FA. The valve-body seal cooperates with a valve surface formed on a conical surface 19 of the liquid channel 8 to close the liquid valve 16. The conical surface 19 is rotationally symmetric relative to the filling-element axis FA.

Figure 2:
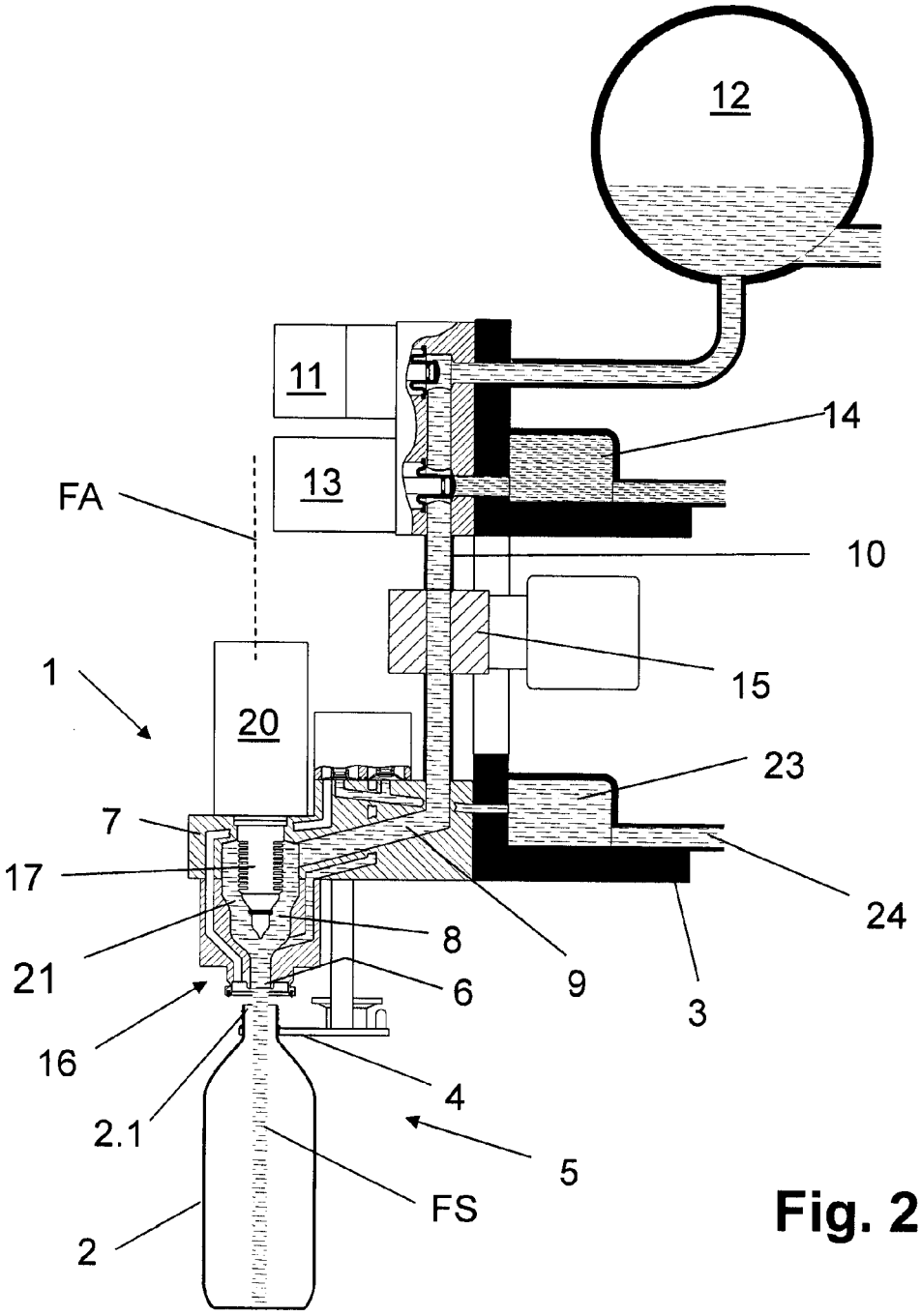
FIG. 2 shows the filling element of FIG. 1 with the liquid valve open.

An actuator 20 opens and closes the liquid valve 16 by moving the valve tappet 17, with its valve body 18, along the filling-element axis FA between a closed position, shown in FIG. 1, and an open position, shown in FIG. 2. In the closed position, the valve body 18 lies with its valve body 18 sealed against the valve face formed by the conical surface 19. In the opened position, a ring-shaped gap 21 forms between the valve body 18 and the conical surface 19.

When the valve is fully-opened, the ring-shaped gap 21 has a substantial gap width. In some embodiments, the gap width exceeds 4 millimeters. In other embodiments, the gap width is between 8 millimeters and 20 millimeters. In yet other embodiments, the gap width is between 13 millimeters and 16 millimeters. These large gap widths permit problem-free filling of the bottles 2 with a mixture made from the first and second constituents.

As shown in detail in FIG. 3, the valve tappet 18 has a first valve-body-segment 18.1, a second valve-body-segment 18.2, and a third valve-body-segment 18.3. The first valve-body-segment 18.1 is closest to a lower free end of the valve tappet 17. The third valve-body-segment 18.3 is furthest from the lower free end of the valve tappet 17. The second valve-body-segment 18.2 is between the first valve-body-segment 18.1 and the third valve-body-segment 18.3.

The first valve-body-segment 18.1 is conical and tapers from a first diameter to a second diameter that is smaller than the first diameter. The portion of the first valve-body-segment 18.1 that has the second diameter is that portion that is closest to the lower free end of the valve tappet 17. The portion of the first valve-body-segment 18.1 that has the first diameter is that portion that is furthest from the lower free end of the valve tappet 17.

The second valve-body-segment 18.2 is a cylindrical segment having a diameter equal to the first diameter.

The third valve-body-segment 18.3 is a frusto-conical segment that has a diameter ranging in value from the first diameter to a third diameter that is greater than the first diameter. The portion of the third valve-body-segment 18.3 that has the first diameter is that portion that adjoins the second valve-body-segment 18.2. The portion of the third valve-body-segment 18.3 that has the third diameter is that portion that is furthest from the second valve-body-segment 18.2. The first valve-body-segment 18.1, the second valve-body-segment 18.2, and the third valve-body-segment 18.3 are all coaxial with the filling-element axis FA.

Referring to FIG. 3, a bellows 22 tightly surrounds that portion of the valve tappet 17 lying above and adjacent to the third valve-body-segment 18.3. The bellows 22 seal the passage of the valve tappet 17 through the housing 7. At the same time, the bellows 22 have an outer diameter that is the same or substantially the same as the third diameter. This avoids having flat segments facing away from the dispensing opening 6. This, in turn, suppresses a suction effect from the dispensing opening 6 into the liquid channel 8 that can otherwise occur when the liquid valve 16 opens. Suppression of this suction effect in turn suppresses agitation of charge present in the liquid channel 8 upon opening the liquid valve 16. This, in turn, reduces entry of ambient air into the liquid valve 16.

In the embodiment shown, the liquid channel 8 is made of a first channel-segment 8.1, a second channel-segment 8.2, a third channel-segment 8.3, and a fourth channel-segment 8.4.

The fourth channel-segment 8.4 ends at the dispensing opening 6. The third channel-segment 8.3 adjoins the fourth channel-segment 8.4. The first channel-segment is furthest from the dispensing opening 6. The second channel-segment 8.2 is between the first channel-segment 8.1 and the third channel-segment 8.3. The first channel-segment 8.1, the second channel-segment 8.2, the third channel-segment 8.3, and the fourth channel-segment 8.4 are all coaxial with the filling-element axis FA.

The first channel-segment 8.1 is defined in part by a cylindrical or substantially cylindrical wall having a first diameter. The product-channel segment 9 empties into this first channel-segment 8.1.

The second channel-segment 8.2 is defined in part by a cylindrical or substantially cylindrical wall having a second diameter. The second diameter is smaller than the first diameter. The cross-sectional area of the second channel-segment 8.2 is smaller than the cross-sectional area of the first channel-segment 8.1.

The third channel-segment 8.3 is defined in part by the conical surface 19 and thus tapers like a hopper in the direction towards the underside of filling element 1. The diameter of the third channel-segment 8.3 is greatest where it adjoins the second channel-segment 8.2 and is smallest where it adjoins the fourth channel-segment 8.4.

The fourth channel-segment 8.4 has a circular cylindrical cross-section and ends with the dispensing opening 6.

When the liquid valve 16 is closed, the first valve-body-segment 18.1 is mostly within the fourth channel-segment 8.4 and the third valve-body-segment 18.3 is mostly within the third channel-segment 8.3.

On first opening of the liquid valve 16, the first and second valve-body-segment 18.1, 18.2 move upward into the second channel-segment 8.2. In the fully opened state of the liquid valve 16, the valve body 18 is held in the second channel-segment 8.2 and the gap 21 attains its maximum width.

To avoid penetration of air bubbles into the liquid channel 8 on opening the liquid valve 16 despite the large opening width of the gap 21, the actuator 20 opens the liquid valve 16 with a greatly reduced opening speed. In some embodiments, it takes more than 100 milliseconds to open the liquid valve 16. In others, it takes between 100 milliseconds and 1000 milliseconds to fully open the liquid valve 16. In yet other embodiments, it takes between 400 milliseconds and 600 milliseconds to fully open the liquid valve 16.

The effect achieved by the relatively slow opening of the liquid valve 16, namely that of avoiding penetration of air bubbles in the liquid channel 8 despite the greater gap width of the gap 21, is also supported by the geometry of the valve tappet 17 and the valve body 18 in the manner described above. The valve tappet 17 and valve body 18 are configured to avoid agitation of the product in the liquid channel 8 and/or flat areas that would cause a suction effect on opening the liquid valve 16. In particular, when opening the liquid valve 16, the gap 21 is only or substantially only formed after the second valve-body-segment 18.2 has emerged from the fourth channel-segment 8.4. The gap 21 enlarges only slowly as long as the first valve-body-segment 18.1 is still in the fourth channel-segment 8.4. As the opening process continues, and as a result of the geometry of the liquid valve 16, the gap 21 continues to enlarge, but slowly, until finally the maximum opening cross-section or maximum gap width of the gap 21 is reached.

The opening speed of the liquid valve 16 is selected so that the acceleration of the charge column in the liquid channel 8 is sufficient so that the additional flow or opening cross-section that results from the increasing opening of liquid valve 16 is filled in each case directly and completely with the charge that ultimately flows through the gap 21 at a flow rate that is high enough to avoid the penetration of air into the liquid valve 16.

The possibility also exists of controlling the opening speed of the liquid valve 16 by corresponding control and/or design of an actuator 20. In particular, the actuator 20 opens the liquid valve 16 in a manner adapted to the acceleration behavior of the charge column present in the liquid channel 8 so that a complete charge jet FS can always be achieved. This tends to thwart penetration of air or air bubbles while nonetheless yielding a filling time that is as short as possible.

Some embodiments also include a heating channel 23 and heated-product line 24 that is common to all filling elements 1. These cooperate to form a heating circuit that either heats the charge or maintains hot charge at a desired temperature.

The invention has been described above in the context of a single example. It is evident that numerous changes and derivations are possible without departing from the fundamental concept of the invention.

Having described the invention, and a preferred embodiment thereof, what is claimed as new, and secured by Letters Patent is:

1. An apparatus comprising a filling element for free-jet filling of containers with a liquid charge, said filling element comprising a filling-element housing comprising a liquid channel formed therein, a liquid valve provided upstream of a dispensing opening, and an actuator device for actuating said liquid valve for controlled discharge of said liquid charge via said dispensing opening into a container arranged with a container opening thereof spaced below said dispensing opening, wherein, in an open state thereof, said liquid valve, when completely open, forms an gap through which said liquid charge flows, said gap having a gap width of at least four millimeters, and wherein said actuating device for said liquid valve is configured to cause said liquid valve to reach said completely open state only after more than one hundred milliseconds from actuation thereof.

2. The apparatus of claim 1, wherein said gap width is between eight millimeters and twenty millimeters.

3. The apparatus of claim 1, wherein said gap width is between thirteen millimeters and sixteen millimeters.

4. The apparatus of claim 1, wherein said actuating device is configured to cause the time for said liquid valve to reach said completely open state to be between one hundred milliseconds and one thousand milliseconds.

5. The apparatus of claim 1, wherein said actuating device is configured to cause a time for said liquid valve to reach said open state to be between four hundred milliseconds and six hundred milliseconds.

6. The apparatus of claim 1, wherein the liquid valve comprises a valve body comprising a valve body segment that, upon commencement of opening of said liquid valve, moves along a segment of said liquid channel, wherein said valve body segment and said liquid channel segment are configured to have a geometry such that a width of said gap formed between said valve body segment and an inner face of said liquid channel segment on first opening of said liquid valve increases as said liquid valve is opened further, and wherein said liquid valve comprises an inner cross section that expands in a direction of opening movement of said valve body.

7. The apparatus of claim 1, wherein said valve body comprises a valve tappet, and wherein said valve tappet has an outer diameter that is the same as a maximum outer diameter of said valve body.

8. The apparatus of claim 1, wherein said valve body comprises a valve tappet, and wherein an element surrounding said valve tappet has an outer diameter that is the same as a maximum outer diameter of said valve body.

9. The apparatus of claim 1, further comprising a bellows, wherein said valve body comprises a valve tappet, wherein said bellows surround said valve tappet, and wherein said bellows have an outer diameter that is the same as a maximum outer diameter of said valve body.

10. The apparatus of claim 1, wherein said liquid channel is designed without an element acting as a gas lock.

11. The apparatus of claim 1, further comprising a circulating filling machine comprising a rotor for supporting a multiplicity of filling elements, including said filling element, said rotor being configured to be driven about a vertical machine axis.

12. The apparatus of claim 1, wherein the liquid valve comprises a valve body comprising a valve body segment that, upon commencement of opening of said liquid valve, moves along a segment of said liquid channel, wherein said valve body segment and said liquid channel segment are configured to have a geometry such that a width of said gap formed between said valve body segment and an inner face of said liquid channel segment on first opening of said liquid valve increases as said liquid valve is opened further, and wherein said valve body segment comprises an outer cross section that reduces in response to said opening movement of said valve body.

13. A method for filling a container, said method comprising free jet filling of a container with liquid charge, wherein free-jet filling comprises providing a filling-element housing comprising a liquid channel formed therein, providing a liquid valve upstream of a dispensing opening, arranging a container so that a container opening thereof is spaced below said dispensing opening, actuating said liquid valve for controlled discharge of said liquid charge via said dispensing opening into said container, wherein actuating said liquid valve comprises causing said liquid valve to transition into a completely open state during which said liquid valve forms an gap through which said liquid charge flows, said gap having a maximum width of at least four millimeters, and causing said liquid valve to reach said completely-open state only after a lapse of at least one hundred milliseconds from actuation.

14. The method of claim 13, wherein causing said liquid valve to transition into said completely-open state comprises causing said gap to reach a maximum width of between eight millimeters and twenty millimeters.

15. The method of claim 13, wherein causing said liquid valve to transition into said completely open state comprises causing said gap to attain a maximum width that is between thirteen millimeters and sixteen millimeters wide.

16. The method of claim 13, wherein causing said liquid valve to reach said completely-open state only after a lapse of at least one hundred milliseconds comprises causing said liquid valve to reach said completely-open state after a lapse of between one hundred milliseconds and one thousand milliseconds.

17. The method of claim 13, wherein causing said liquid valve to be in said open state comprises causing said liquid valve to be in said open state for between four hundred milliseconds and six hundred milliseconds.

* * * * *